United States Patent [19]

Tardy et al.

[11] Patent Number: 4,460,438

[45] Date of Patent: Jul. 17, 1984

[54] PROCESS FOR THE ELECTROLYTIC DEPOSIT OF CHROMIUM

[75] Inventors: René Tardy; Patrick Benaben, both of Firminy, France

[73] Assignee: Association pour Recherche et le Development des Methodes et Processu Industriels (ARMINES), Paris, France

[21] Appl. No.: 434,841

[22] Filed: Oct. 18, 1982

Related U.S. Application Data

[63] Continuation of Ser. No. 229,722, Jan. 28, 1981, abandoned.

[30] Foreign Application Priority Data

Jan. 28, 1980 [FR] France ..... 80 01741

[51] Int. Cl.[3] ..... C25D 3/06

[52] U.S. Cl. ..... 204/51

[58] Field of Search ..... 204/51

[56] References Cited

U.S. PATENT DOCUMENTS 4,142,948 3/1979 Tajima et al. ..... 204/43 R

OTHER PUBLICATIONS

Larissa Domnikov, Metal Finishing, pp. 107–109, vol. 64, No. 6, (1966).

*Primary Examiner*—G. L. Kaplan

*Attorney, Agent, or Firm*—McAulay, Fields, Fisher, Goldstein & Nissen

[57] ABSTRACT

A process for the electrolytic deposition of chromium by means of a bath of trivalent chromium is characterized in that it uses, as electrolyte, a solution which is obtained by careful reduction of the chromic acid in a sulfuric medium by an excess of a reducing agent of the alcohol type, such as methanol. Subsequently this solution is diluted with water without indispensable addition of additional products. The electrolysis is effected without separation of the anodic and cathodic compartments at an anode-cathode potential difference greater than 6 volts, the cathodic current density being of the order of 10 to 40 amperes per $dm^2$, the concentration of trivalent chromium ranging from 0,1 to 1 ion-gram per liter and the pH from 1 to 1,5.

1 Claim, No Drawings

PROCESS FOR THE ELECTROLYTIC DEPOSIT OF CHROMIUM

This is a continuation of application Ser. No. 229,722 filed Jan. 28, 1981 and now abandoned.

The present invention relates to a process for the electrolytic deposition of chromium by means of a trivalent chromium bath.

The electrolytic deposition of chromium, or chrome-plating, is generally effected by electrolysis of an aqueous solution of concentrated chromic acid (hexavalent chromium) in the presence of catalyst ions (of the sulfate or fluoride type).

This process presents a certain number of well known drawbacks. One of these drawbacks is the high toxicity of chromic acid which, in order to comply with the work safety and hygiene regulations, requires a special, expensive fitting out of the workshops in order to purify the vapours issuing from the chrome-plating vats in the course of electrolysis and in particular a complex treatment of the effluents (baths, rinsing water, etc . . . ). Furthermore, the current yield obtained with this process is very average (always less than 30%). In addition, this process involves very high losses of chromium, for example during rinsings of the chrome-plated pieces or when the chrome-plating baths are renewed, due to the high concentration of hexavalent chromium in the bath.

Numerous modifications to this type of bath have been proposed, with a view to increasing the performances thereof, particularly concerning the current yield of the electrolysis and the quality of the deposits.

More recently, other processes have been envisaged which use, as electrolyte, trivalent chromium in organic or half-aqueous, half-organic solution, generally with a separation of the anodic and cathodic compartments. However, these processes, using trivalent chromium as electrolyte, in turn, present drawbacks, as either their performance is mediocre (limited adherence of the chromium deposit, depositable thickness generally less than 3 microns, low current yield), or they are expensive, as they use expensive organic solvents, this cancelling any savings arising out of simpler conditions of exploitation than with hexavalent chromium, or they are limited in their possibilities of chrome-plating complex pieces (due to the necessary separation of the anodic and cathodic compartments).

SUMMARY OF THE INVENTION

It is an object of the present invention to remedy the drawbacks of known process using trivalent chromium as electrolyte, due to particularly simple means.

To this end, this process for the electrolytic deposit of chromium by means of a bath of trivalent chromium is characterised in that a solution is used as electrolyte, which is obtained by careful reduction of the chromic acid in a sulfuric medium by an excess of a reducing agent of the alcohol type, such as methanol, and by subsequent dilution of this solution with water without indispensable addition of additional products, and electrolysis is effected without separation of the anodic and cathodic compartments at an anode-cathode potential difference greater than 6 volts, the cathodic current density being of the order of 10 to 40 amperes per $dm^2$, the concentration of trivalent chromium being able to vary from 0.1 to 1 ion-gram per liter and the pH from 1 to 1.5.

The trivalent chromium content of the bath is very largely lower than that of the present bath of hexavalent or trivalent chromium. In a particular, nonlimiting application of the process according to the invention, it has been observed that the best results were obtained with an electrolyte containing about 0.2 ion-gram per liter of trivalent chromium.

The anode used is constituted by a metal preventing as much as possible the formation of hexavalent chromium by anodic oxidation. In fact, from a certain concentration in the bath, the hexavalent chromium considerably hinders the deposit both from the standpoint of quality (granulous but adherent deposit) and of quantity (clearly reduced cathodic yield). The tests carrying out the process according to the invention with anodes made of platinum or nickel enable excellent results to be obtained.

An intrinsic current yield greater than 30% was thus able to be obtained, for a pH of the order of 1.3 and for a temperature of about 20° C., a speed of deposit greater than 1 micron per minute for an electrolysis lasting five minutes and a deposit of chromium of excellent appearance on different materials, particularly zinc.

The process of electrolytic deposition according to the invention presents a certain number of advantages over the heretofore known processes.

In the first place, with respect to the known chrome-plating bath prepared from trivalent chromium, it enables a clearly lower cost price of the bath to be attained, due to its extreme simplicity. In addition, as it has been seen previously, the current yield is higher than those obtained heretofore. The chromium content in the bath is lower and this leads to a lower loss of chromium during rinsings and further to the inevitable mechanical drive due to the pieces to be chrome-plated. When used baths are renewed, the quantity of chromium lost, in the form of waste, is less, for the same volume of solution used. With respect to the majority of chrome-plating baths, the absence of separation of the anodic and cathodic compartments allow complex pieces to be chrome-plated. The process according to the invention also enables thicknesses of chromium of a few tens of microns to be deposited, whilst maintaining a smooth, shiny appearance. The colouring and presentation of the deposit is quite comparable with those obtained from baths of hexavalent chromium.

With respect to the chrome-plating baths prepared from hexavalent chromium, the advantages offered by the process according to the invention are as follows: the operating conditions are not much different from those used for the baths of hexavalent chromium. The intrinsic current yield is greater than 30%, which leads to a considerable saving of the amount of energy used with respect to the baths of hexavalent chromium (this high current yield is doubled since the metal is reduced, not by the degree of oxidation six, but three). The problems of toxicity and of treatment of the effluents are considerably reduced. The process tolerates the interruption of the electric current. Under certain conditions, it allows pieces to be chrome-plated again and chromium to be deposited on a large variety of materials, and in particular on zinc. Finally it is possible to apply the process according to the invention to the conventional chrome-plating baths (hexavalent chromium) when they have come to the end of their operation.

What we claim is:

1. A process for the electrolytic deposition of chromium comprising:

effecting electrolysis in communicating anodic and cathodic compartments at an anode-cathode potential difference greater than 6 volts, the cathodic current density ranging from 10 to 40 amperes per $dm^2$, using a nickel anode and a trivalent chromium bath containing from 0.1 to 1 ion-gram per liter of trivalent chromium and wherein the pH ranges from 1 to 1.5;

said bath consisting of a solution obtained by reduction of chromic acid in sulfuric acid medium by an excess of methanol and subsequent dilution of the resulting solution with water.

* * * * *